US011864602B2

(12) United States Patent
Dorsey

(10) Patent No.: US 11,864,602 B2
(45) Date of Patent: Jan. 9, 2024

(54) PERSONAL PROTECTOR SHIELD

(71) Applicant: Clay Robinson Dorsey, Birmingham, AL (US)

(72) Inventor: Clay Robinson Dorsey, Birmingham, AL (US)

( * ) Notice: Subject to any disclaimer, the term of this patent is extended or adjusted under 35 U.S.C. 154(b) by 91 days.

(21) Appl. No.: 17/803,039

(22) Filed: Jan. 21, 2022

(65) Prior Publication Data

US 2022/0225698 A1 Jul. 21, 2022

Related U.S. Application Data

(60) Provisional application No. 63/199,683, filed on Jan. 17, 2021.

(51) Int. Cl.
*A41D 13/04* (2006.01)
*A41D 27/08* (2006.01)

(52) U.S. Cl.
CPC ..... *A41D 13/04* (2013.01); *A41D 27/08* (2013.01); *A41D 2400/52* (2013.01); *A41D 2500/30* (2013.01); *A41D 2500/40* (2013.01)

(58) Field of Classification Search
CPC .. A41D 13/04; A41D 13/046; A41D 2400/42; A41D 2500/30; A41D 2500/40; A61B 2046/205; A47G 11/002
USPC ..... 2/48, 51
See application file for complete search history.

(56) References Cited

U.S. PATENT DOCUMENTS 431,332 A * 7/1890 Chadwick ..... A41D 13/04 2/48
1,327,625 A * 1/1920 Maril ..... A41D 13/04 D2/743
3,359,149 A * 12/1967 Hummel ..... A41B 13/10 156/251
3,727,236 A * 4/1973 Lloyd ..... A41D 13/04 2/5
3,774,240 A * 11/1973 Johnson ..... A41D 13/04 2/51
3,793,644 A * 2/1974 Kellner ..... A41D 15/002 2/48
3,815,153 A * 6/1974 Vitol ..... A41D 13/04 206/278

(Continued)

*Primary Examiner* — Heather Mangine
(74) *Attorney, Agent, or Firm* — Lambert Shortell & Connaughton; David J. Connaughton, Jr.; Justin P. Tinger

(57) ABSTRACT

A disposable personal protector shield mainly for individuals involved in food preparation in the food service industry, such as all types of restaurants, food trucks, grocery stores and the like. Alternatively, the disposable personal protector shield can be used for painters to be protected from splashes and spills. The disposable personal protector shield provides the user with an easy and convenient application using adhesive tape strip elements around its perimeter which can be attached directly to one's garment or skin. In addition, the disposable personal protector shield has an antimicrobial protection coating with antimicrobial properties that protect against growth of viruses, germs, mildew, bacteria and the like. The biodegradable material and the disposable personal protector shield can be easily discarded after each use. Even more so, the functionality of the disposable personal protector shield promotes good hygienic methods and practice for the preparation of food.

13 Claims, 6 Drawing Sheets

(56) References Cited

U.S. PATENT DOCUMENTS 3,916,447 A * 11/1975 Thompson ..... A47C 31/113 2/243.1
3,979,776 A * 9/1976 Gruenwald ..... A41B 13/10 24/1
4,030,139 A * 6/1977 Sonntag ..... A41D 13/04 2/51
4,225,977 A * 10/1980 Smith ..... A41B 13/10 2/48
4,266,299 A * 5/1981 Beal ..... A41D 13/04 2/46
4,288,877 A * 9/1981 Klepfer ..... A41B 13/10 2/48
4,304,006 A * 12/1981 Swart ..... A41B 13/10 2/49.1
4,306,316 A * 12/1981 Klepfer ..... A47G 11/002 2/48
4,330,888 A * 5/1982 Klepfer ..... A41B 13/10 2/48
4,423,523 A * 1/1984 Bodner ..... A41B 13/10 2/48
4,479,492 A * 10/1984 Singer ..... A61B 46/00 128/853
4,543,668 A * 10/1985 Franklin ..... A41B 13/10 2/48
4,569,341 A * 2/1986 Morris ..... A61B 46/00 128/853
4,660,224 A * 4/1987 Ashcraft ..... A41B 13/10 2/48
5,056,159 A * 10/1991 Zemke, Jr. ..... A41B 13/10 2/46
5,062,158 A * 11/1991 Oka ..... A41B 13/10 2/48
5,100,710 A * 3/1992 Rizzuto ..... A41B 13/10 206/390
5,476,697 A * 12/1995 Bellander ..... A47G 11/002 428/355 R
5,640,975 A * 6/1997 Diao ..... A61B 46/00 128/853
5,669,770 A * 9/1997 Fisher ..... A61B 46/00 433/137
5,672,056 A * 9/1997 Fisher ..... A41B 13/10 433/137
5,740,552 A * 4/1998 Smith ..... A41D 13/04 2/48
H1738 H * 7/1998 Reinhart, Jr. ..... A41B 13/10 2/49.1
5,864,878 A * 2/1999 Mashrick ..... A41B 13/10 2/46
5,881,382 A * 3/1999 Bernard ..... A41B 13/10 2/48
5,930,836 A * 8/1999 Morris ..... A41B 13/10 2/49.1
RE36,924 E * 10/2000 Fisher ..... A41B 13/10 433/137
6,317,890 B1 * 11/2001 Kuhn ..... A41B 13/10 2/52
D458,436 S * 6/2002 Santillana ..... A41B 13/10 D2/860
6,446,831 B1 * 9/2002 Smith ..... A41D 13/04 221/48
6,493,879 B1 * 12/2002 Hibler ..... A41B 13/10 2/49.1
7,103,916 B1 * 9/2006 Goodew ..... A41B 13/10 2/49.1
7,181,771 B1 * 2/2007 Naehu ..... A41B 13/10 2/48
7,380,284 B1 * 6/2008 Dodani ..... A41B 13/10 2/49.1
7,987,519 B1 * 8/2011 Raso ..... A41B 13/10 2/49.1
8,863,747 B1 * 10/2014 Stephenson ..... A61B 46/00 128/854
9,845,034 B1 * 12/2017 Lew ..... B64D 11/0627
11,044,952 B1 * 6/2021 Hibler ..... A41B 13/10
11,547,220 B1 * 1/2023 Pogue ..... B62B 3/1444
2001/0001412 A1 * 5/2001 Liebmann ..... A41B 13/10 156/247
2003/0213042 A1 * 11/2003 McCloskey ..... A41B 13/10 2/49.1
2006/0021106 A1 * 2/2006 Snodgrass ..... A41D 13/04 2/48
2006/0107435 A1 * 5/2006 Westcott ..... A41D 17/02 2/69
2006/0174390 A1 * 8/2006 Wakhloo ..... A41D 13/04 2/48
2007/0022509 A1 * 2/2007 Bloom ..... A41B 13/10 2/49.1
2007/0118949 A1 * 5/2007 LaGrone ..... A41D 13/04 2/48
2007/0141940 A1 * 6/2007 Baychar ..... D04H 13/001 442/337
2007/0199123 A1 * 8/2007 Friedland ..... A41B 13/10 2/49.1
2007/0277281 A1 * 12/2007 Fitzgerald ..... A47G 11/002 2/53
2008/0092263 A1 * 4/2008 Good ..... A41D 13/04 2/48
2008/0283064 A1 * 11/2008 Block ..... A61B 46/00 128/853
2009/0070910 A1 * 3/2009 McNally ..... A41D 13/04 2/46
2009/0205098 A1 * 8/2009 Araquistain ..... A45D 44/08 2/48
2011/0030702 A1 * 2/2011 Czajka, Jr. ..... A61B 46/00 128/849
2011/0206299 A1 * 8/2011 Carmody ..... B65D 81/363 2/87
2011/0296577 A1 * 12/2011 Jackson, Jr. ..... A41D 13/04 2/48
2012/0015136 A1 * 1/2012 Ziserson ..... A41D 13/08 428/80
2012/0042431 A1 * 2/2012 Lee ..... A41D 13/04 2/48
2012/0053616 A1 * 3/2012 Dedo ..... A61B 90/50 606/202
2012/0110714 A1 * 5/2012 Pokorny ..... A41D 13/04 2/48
2013/0074239 A1 * 3/2013 Cheng ..... A41B 13/10 2/52
2013/0086724 A1 * 4/2013 Stout ..... A41B 13/10 2/48
2013/0086725 A1 * 4/2013 Sabre ..... A41B 13/106 2/49.1
2013/0161984 A1 * 6/2013 Yaghmai ..... A41B 13/106 2/49.3
2014/0115763 A1 * 5/2014 Orozco ..... A41B 13/10 2/455
2014/0230117 A1 * 8/2014 Schnitzlein ..... A41D 13/04 2/48
2014/0304881 A1 * 10/2014 Weaver ..... A41B 13/10 2/48
2014/0352021 A1 * 12/2014 Dowling ..... A41B 13/10 2/48
2015/0020285 A1 * 1/2015 Joyce ..... A41D 27/12 2/48
2016/0008072 A1 * 1/2016 Pecora ..... A61B 46/27 128/853
2016/0219949 A1 * 8/2016 Alexander ..... B60N 2/6036
2017/0086515 A1 * 3/2017 Ruiz ..... A41D 13/0575
2017/0105807 A1 * 4/2017 Puentes ..... A61B 46/00
2017/0143056 A1 * 5/2017 Verkamp, III ..... A41D 13/04
2017/0224032 A1 * 8/2017 McCoy Strosnider ..... A41B 13/10
2017/0281289 A1 * 10/2017 Ahmad ..... A61B 46/40
2018/0020743 A1 * 1/2018 Moore ..... A41B 13/10 2/49.1
2018/0049487 A1 * 2/2018 Blackshear ..... A41D 13/04
2018/0201431 A1 * 7/2018 Vincent ..... B65D 81/363

(56) References Cited

U.S. PATENT DOCUMENTS

| | | | | |
|---|---|---|---|---|
| 2018/0206558 | A1* | 7/2018 | Bannan | A41D 13/04 |
| 2018/0229006 | A1* | 8/2018 | Tooke | A41D 13/1245 |
| 2021/0329979 | A1* | 10/2021 | Oget | A41B 13/10 |
| 2022/0167729 | A1* | 6/2022 | Youssif | A41D 3/08 |
| 2022/0225698 | A1* | 7/2022 | Dorsey | A41D 27/08 |
| 2022/0273057 | A1* | 9/2022 | Ponich | A41D 13/1209 |
| 2022/0411996 | A1* | 12/2022 | Ward | D06M 11/83 |
| 2023/0000177 | A1* | 1/2023 | Weaver | A47G 11/002 |
| 2023/0000183 | A1* | 1/2023 | Markel | A41B 13/103 |
| 2023/0180861 | A1* | 6/2023 | Mittig | A41D 13/04 |

2/51

* cited by examiner

PERSONAL PROTECTOR SHIELD

REFERENCE TO RELATED APPLICATIONS

This application claims priority to Provisional Utility Patent Application No. 63/199,683 filed on Jan. 17, 2021. Provisional Utility Patent Application No. 63/199,683 is incorporated by reference herein. Applicant claims the earlier filing date.

TECHNICAL FIELD OF THE INVENTION

The technology described herein relates to the field of protective coverings that are disposable. More specifically, the invention is a biodegradable disposable body shield that protects the torso and upper leg area of a wearer from coming in contact with contaminants in an unsanitary environment. Moreover, the disposable body shield prevents any contaminants on the clothing of a wearer from being transmitted to food, medicine, and the like. In addition, the disposable personal protector shield has any known antimicrobial protection coatings. For example, antimicrobial properties that protect against growth of viruses, germs, mildew, bacteria and the like. Also, in addition, it has an attachment element with any known adhesives, for example adhesive strips attaching directly to one's bare skin or garment. Alternatively, the disposable body shield can be adapted for multiple uses prior to discarding and serve as a marketing/advertising platform. The disposable body shield has any known changing inks, for example, photochromic changing inks that activate when exposed to sunlight. This technology is use for displaying sunlight-activated features for outdoors that displays welcoming and safe messages worn by employees at food establishments such as restaurants when serving curbside patrons.

BACKGROUND OF THE INVENTION

Efforts have been made to promote sanitary conditions in the method of preparing food in the food services industry. Traditionally workers in the food service industry typically wear cloth aprons which are worn several times without cleaning as well as plastic aprons which are environmental hazards, once discarded. In some case, workers in the food services industry may not even ware aprons. This has created an environment where once workers come from their lunch, smoking or restroom break with or without an apron will have harmful bacteria and virus causing particles and debris along the front part of their apron garment or clothing from perhaps inadvertently leaning against unsanitary restroom lavatory counters and splashing from toilet and urinals facilities which can lead to cross contamination which causes sickness and diseases.

Body shields are worn on many types of jobs. Years ago, all body shields for commercial and residential use were made of fabric and were regularly laundered. In recent years, disposable body shields made of flexible plastic film have become more and more popular for use in these environments which are non-biodegradable and release toxins into the environment. Also, only a limited amount of plastics are properly recycled or reused.

U.S. Pat. No. 9,320,304 B1 discloses a bib or apron for use by infants, young children, older adults or person with special needs to protect their clothing and/or furniture from food and liquid spills. The apron further includes two or more bifold straps that are placed along the sides of the garment. The bifold straps are wrapped around the bottom of the apron and are secured to the back of the apron via two or more attachment devices to maintain the integrity of the flexible pocket. Moreover so, the bifold straps with its attachment devices is intended to connect to each other instead of attaching directly to the bare skin or garment. The bib or apron is intended to be reused instead of being a disposable biodegradable embodiment. Also, the functional design is only intended to protect one's clothing and/or furniture from food and liquid spills. The embodiment does not address a hygienic element or method for food preparation.

U.S. Pat. No. 2015/0173434 A1 discloses an outer garment that includes an upper portion having upper portion pliant edges and two neck end portions to secure the upper portion to a user's neck; and a lower portion joined to the upper portion. The lower portion includes pliant lower portion edges coupled to the upper portion pliant edges; a pliant support mesh/grid covering a rectangular area defined by the lower portion edges; and an edge joining fastener or strap mechanism/system to secure two adjacent lower portion edges together. The outer garment includes a three-dimensional tray/receptacle that is formed when the lower edges are joined together by hook-and-loop fasteners. The design functional intent does not addresses preventing any contaminants on the clothing of a wearer from being transmitted to food, medicine, and the like. Moreover, the fastener or strap mechanism/system is not intended to connect directly to the bare skin or garment. The outer garment is intended to be reused instead of being a disposable biodegradable embodiment. The embodiment does not address a hygienic element or method for food preparation.

KR. Pat. No. 20110009584U discloses an apron which prevents food from falling on the pants or the floor when it is ingested, and at the same time, disposable aprons that make it easy to remove the apron after eating. The invention relates to a cutout line formed at a predetermined portion of a necklace band having an insertion hole in the necklace part, and a first cutout line, a second cutout line, and an adhesive part are formed in the body part so that food spaces can be gathered apart. It is characterized in that the pouch having a folding band is formed by folding the bottom of the apron like a pouch to prevent food from falling on the user's clothes or floor when ingesting food, as well as apron after ingesting food pulling the incision cuts off the cut line formed on the neckband. The design and function of the adhesive part formed in the body part of the invention is intended to create a folding band that is formed by folding the bottom of the apron into a pouch. Moreover, the adhesive part is not intended to connect directly to the bare skin or garment. All though the apron is disposable, however it is not biodegradable because the embodiment of the apron contains aluminum material. Also, the embodiment does not address a hygienic element or method for food preparation.

JP. Pat. No. 2016129955A discloses an invention that provides protective clothing for food that can easily find a broken piece even if the broken piece is mixed in food. The invention also, discloses protective clothing for food comprising a synthetic resinous food apron and/or a synthetic resin food arm cover used when handling food regarding workers who work in food factories or the like working while wearing work clothes. Moreover, the inventions attachment device does not adhere directly to the bare skin or garment. Although, the invention's embodiment detects broken foreign matters mixed in food, it does not incorporate a preventive measure regarding cross contamination in food such as antimicrobial properties that protect against growth of viruses, germs, mildew, bacteria and the like. If the protective clothing does not have an antimicrobial property before foreign matters are found in the food, this will result in the entire food source being contaminated.

Accordingly, a need exists for a disposable body shield that will be manufactured from an elongated strip of biodegradable and antibacterial material during the manufacturing process where the strip is repeatedly perforated, cut with an adhesive element applied that will be used for attaching the body shield to the wearer. The logos, graphics and photochromic changing inks are pre-applied onto the material before cut and rolled into sheets or strips. The sheets or strip are arranged into a roll and packaged. At the point of use, individual sheets (each one constituting a disposable body shield) are pulled off the roll at the perforations which can be applied to the body of the wearer quickly and efficient by the adhesive elements.

Also, a need exists for a protective garment that is worn on top of other clothing or the bare skin of a wearer that is very hygienic and easy-to-use, disposable and prevents germs, food, spills, and other contaminants from directly contacting clothing and as well protecting food being prepared that is worn by a wearer which also can be easily discarded.

SUMMARY OF INVENTION

The present invention relates to a disposable body shield, and more particularly, to a very hygienic and easy-to-use disposable body shield that prevents germs, bacteria and other unwanted contaminants from directly contacting clothing and also contaminating food being prepared by the user, by covering the body when in use and which can be easily discarded after the user completes a task. More so, when used in restaurants, delis and grocery stores it will protect the customers' food from contaminants during food preparation. Especially as the food preparer leans against prep tables with their clothing which perhaps has been exposed to germs, viruses and bacteria from inadvertently leaning against unsanitary restroom lavatory counters and splashing from toilet facilities as well as cigarette smoke during breaks. However, conventional body shields are not used and discarded after initial use in the food service industry, but they are reused by a wearer(s) and become unsanitary. Hence, a subsequent user would be reluctant to the conventional aforementioned body shield. This can be very problematic in environments where unwanted contaminants are prevalent.

The present invention was devised to solve the above problems. The disposable body shield is very hygienic and easy to use, for example with any known body part having adhesive elements disposed thereon, once used and thrown away as a whole and is made of any known impermeable synthetic, synthetic or non-woven biodegradable material such as perhaps for example, wax coated laminated paper, wax paper and etc. Alternatively, the disposable body shield can be adapted with a yoke, arm coverings, and the like for additional support.

Alternatively, the disposable body shield can be adapted by attaching an adhesive tape to the back edge of the body portion in contact with the user's body, to form a left and right appendage to the left and right of the body portion to encircle the waist when earing the disposable body shield. This alternative embodiment is similar to a conventional apron.

The present invention, in order to solve the technical problem as described above, [[in]] is the disposable body shield that covers the front and partially sides of the body to prevent contact with contaminants, the disposable body shield is made of a non-woven material that is preferably biodegradable or synthetic. As will later be discussed, impermeable synthetic materials are ideal to stop the spread of microscopic germs.

The disposable body shield is of a unitary rectangular construction that comprises a top edge having corresponding edges from which downwardly contoured cut-out sections at the distal point of which the remainder of the body portion extends. The top edge is designed to be placed generally along the collar bone area of user. The cut-out sections are provided to accommodate unimpeded movement of the arms of the user. The remaining body portion is designed to cover the remainder of the torso and upper leg region. The unitary construction is ideally one-size-fits-all for the average user, so the coverage areas will vary on users who fall out of that average spectrum. It should be noted that the disposable body shield can be manufactured according to any size variants from very tall to very obese to infant use.

A strategically placed adhesive element is placed along the backside of the top edge, contoured section, and lower area of the body part. In this embodiment, the adhesive element comprises a commercial adhesive along said backside that is covered by a corresponding layer of biodegradable cover film to prevent the adhesive from attaching to another object prematurely. Once a user removes a disposable body shield from the roll or packaging. The biodegradable cover film is removed and the commercial adhesive is exposed. The disposable body shield can now be aligned and affixed to the body of the user in a removably joined manner with forced manual application. The strength of the commercial adhesive may vary depending on the environment the disposable body shield is used. As the disposable body shield is removably joined, once the user is finished with his task or exposure to contaminants. The disposable body shield is peeled off the user with application of minimum manual force and subsequently disposed. The use of adhesives obviates the need for a yoke portion around the neck of the user to support the disposable body shield. While a yoke portion is envisioned in alternative embodiments, the preferred embodiment is optimal for users that do not want to risk tousling their hair or prefer not to remove headwear. There is a segment of the population that also prefers not to have the feeling of a yoke on their necks.

The adhesive element is positioned along backside as described to contact the clothing or skin of the user and supports the body portion during use. In general, pressure-sensitive adhesives are not known to irritate human skin or damage clothing. If the adhesive is strong enough to cause pain or damage when removing the disposable body shield from the skin, then any pressure-sensitive adhesive known to those skilled in the art and suitable for the intended purpose can be used. Desirably, the adhesive should be selected such that when the disposable body shield is removed by the user after use, no significant amount of adhesive residue remains on the surface of the skin or clothing of the user.

The preferred embodiment teaches the adhesive element laminate that spans the underside edges of the top edge, cut-sections, and a segment of the lower body portion of the disposable body shield. As an alternative, a series of advantageously placed strips is also within the scope of this invention and may reduce costs. Adhesive strips segments placed underneath the top edge, in the corresponding contoured pits of the cut-sections, and the upper area of the remaining body part will serve the purpose of removably joining the disposable body shield to the garments or skin of the user.

The use of adhesive elements eliminates the need for a yoke around the neck or corresponding protruding appendages (straps) that wrap around the waist of a user to support the disposable body shield on the person of the user. Moreover, the removal of the disposable body shield is expedited in the absence of the time and force required to remove yoke and untie/rip the corresponding appendages. However, these features do fall comfortably within the scope of alternative embodiments.

In the preferred embodiment, the disposable body shield is formed integrally of the non-woven material while the adhesive tape is attached to the back edge of the body portion. As such, the front of the disposable body shield serves as a blank canvas upon which the advertising materials, logos, and social media/website information can be superimposed, thus transforming the disposable body shield into a disposable advertisement having the functional purpose of shielding the clothes and body of a user.

In an alternative embodiment, the portions or all of the disposable body shield can be constructed from materials that glow in the dark, thus making the disposable body shield ideal for users that work in dark or low-light conditions thus protecting the clothes and body of user while increasing the visibility of a user. For instance, users that work in night road construction or low-lit venues where social distancing is not effective, the luminescent disposable body shield serves to protect the wearer from road grime or touching clothing that may have germs, like the coronavirus, lurking on the surface.

The world is currently in a pandemic caused by a coronavirus known as COVID-19. This virus is spread by droplets from the nose and mouth of an infected person that conveyed by air, touch, or direct contact o/with an uninfected host body. This transmission can occur if an uninfected host touches droplets of COVID-19 dispersed on their clothing and subsequently touches their eyes, mouth, nose, or any entry point for the virus. In this situation, a disposable body shield made from impermeable synthetic materials is preferable over biodegradable materials that may be compromised given the microscopic dimensions of COVID-19. In addition, the disposable body shield has an antimicrobial protection coating with antimicrobial properties that protect against growth of viruses, germs, mildew, bacteria and the like.

Still another alternative embodiment of the disposable body shield introduces a split below the groin area and from which two downwardly depending tapered leg sections extend subsequently terminating in a length sufficiently long enough to cover the respective upper ankle portions and extend forward to cover the top of the respective shoes—particularly the shoelaces. The adhesive elements would extend strategically along this alternative design to ensure a secure fit. This alternative embodiment promotes maximum coverage of the front areas of the torso, legs, and feet while not impeding the mobility of a user. It is a decided advantage over standard body shields and aprons that terminate around the knees. Moreover, this embodiment severely obviates the need and discomfort of wearing full body suits when front covering is more than adequate most environments.

It should be noted that the preferred and alternative embodiments of the disposable body shield can be placed on the back of the user by the user and subsequently removably joined across the top of the back, the backs of the corresponding armpits, and the corresponding lower back regions to effect a larger coverage on the person of the user and thus decreasing the likelihood a contaminant is introduced on the skin or clothing of the user. The disposable body shield can be adhesively secured to the back and subsequently removed therefrom without the assistance of another person.

PAINTING: The disposable body shield can be donned by painters to protect their persons while engaged in painting. In addition, the disposable body shield can be used as a dropcloth to prevent paint from inadvertently being spilled on covered surfaces such as floors, furniture, etc.

DELIVERY SYSTEMS: A plurality of disposable body shields can be placed in public areas to encourage covering the body to reduce the transmission of airborne pathogens and contaminants on the person of the wearer.

Obviously, many modifications and variations of the present invention are possible in light of the above teachings. It will be appreciated by those skilled in the art that the device can be constructed from any suitable material and is adaptable to many colors, prints, and themes. In the preferred embodiment, the device is flexible to promote elasticity and enhance the protective qualities of the instant invention. The device can alternatively be adapted with a semi-rigid fabric. Moreover, reusable and long-term use embodiments of the device are within the scope of the present invention.

While the present invention has been explained by a detailed description of a preferred embodiment, it is understood that various modifications and substitutions can be made with respect to the preferred embodiment or embodiment described herein within the scope of the present invention and its equivalents. It will be apparent; however, that variations and modifications may be made by those skilled in the art to the disclosed embodiments of the invention, with the attainment of some or all of its advantages and without departing from the spirit and scope of the present invention. These and other features and advantages of the present invention will become apparent from the following description, drawings and claims.

DETAILED DESCRIPTION OF DRAWINGS

Figure 1:
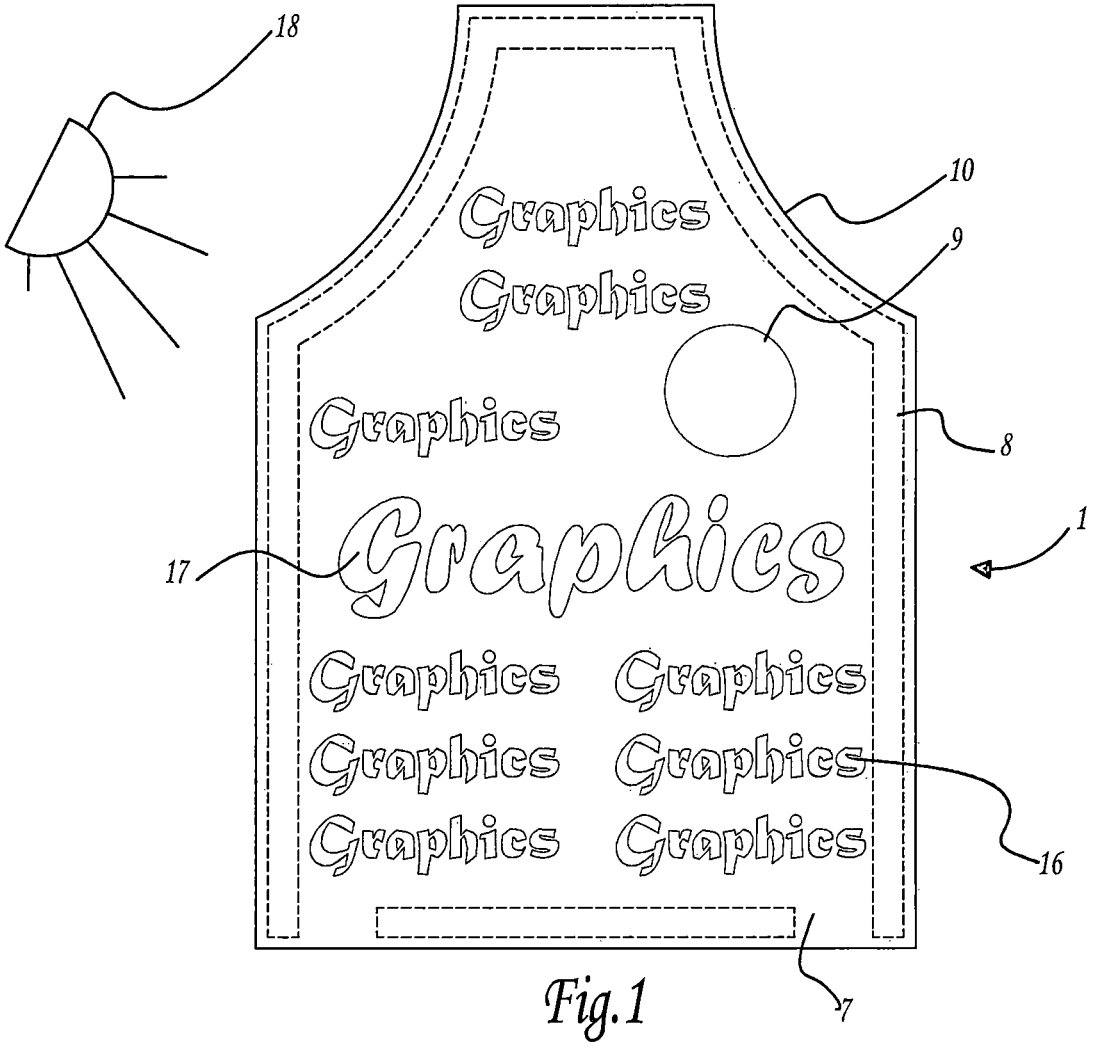
FIG. 1 illustrates the disposable body shield of the present invention in accordance with the one embodiment.
Figure 2:
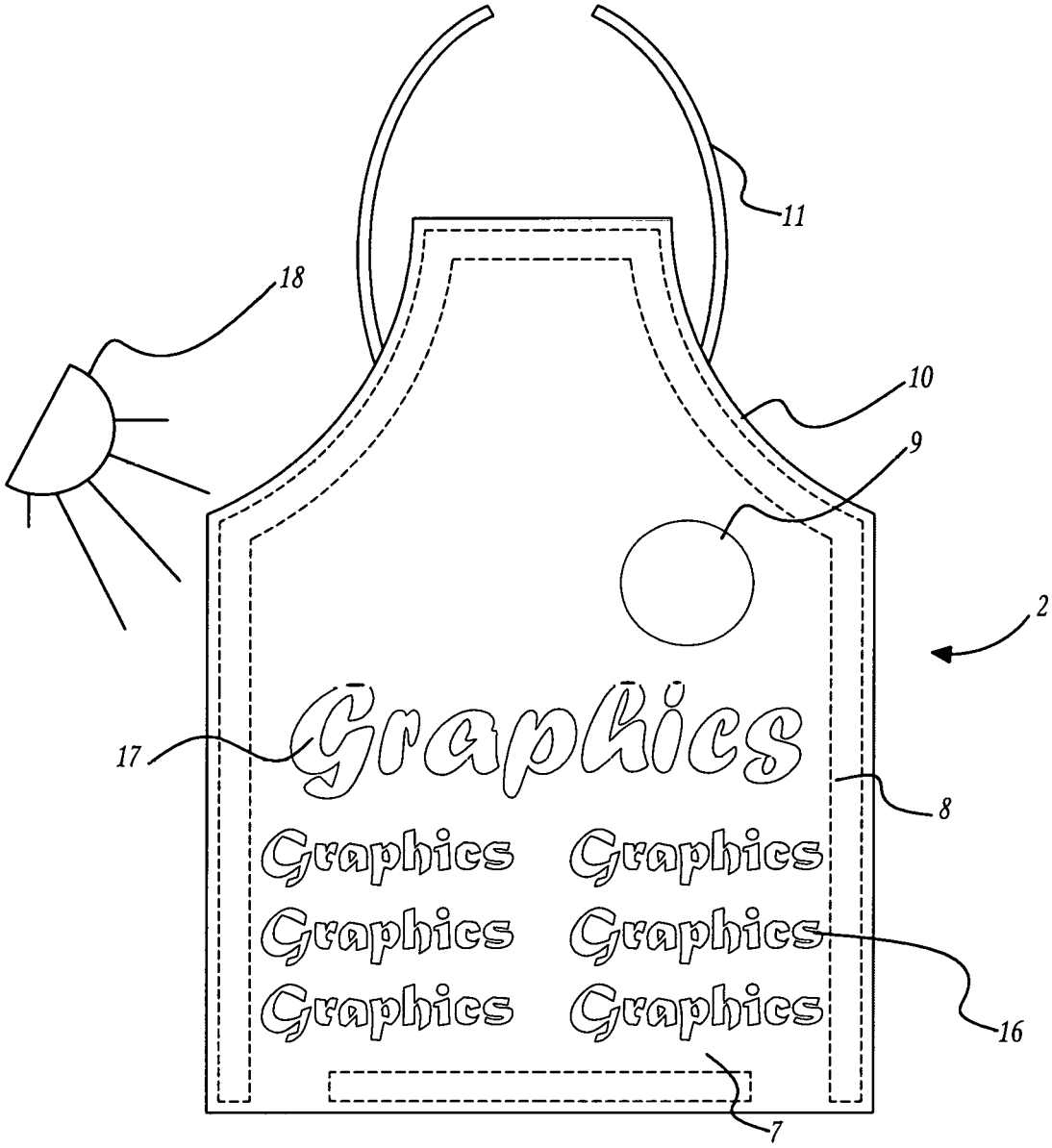
FIG. 2 illustrates the disposable body shield of the present invention in accordance with the one embodiment wherein the disposable body shield has a yoke.
Figure 3:
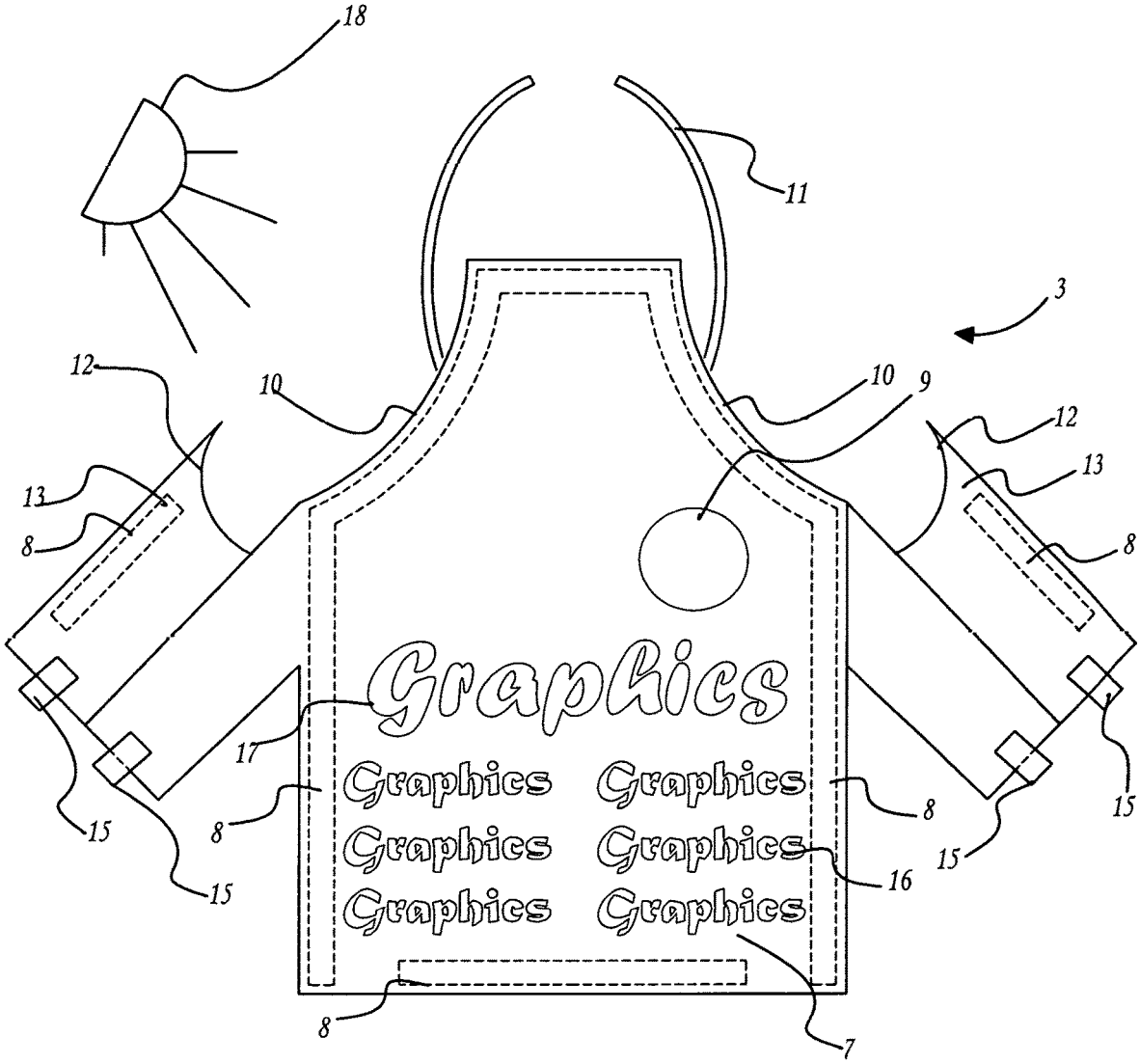
FIG. 3 illustrates the disposable body shield of the present invention in accordance with the one embodiment wherein the disposable body shield has a yoke and arm coverings.
Figure 4:
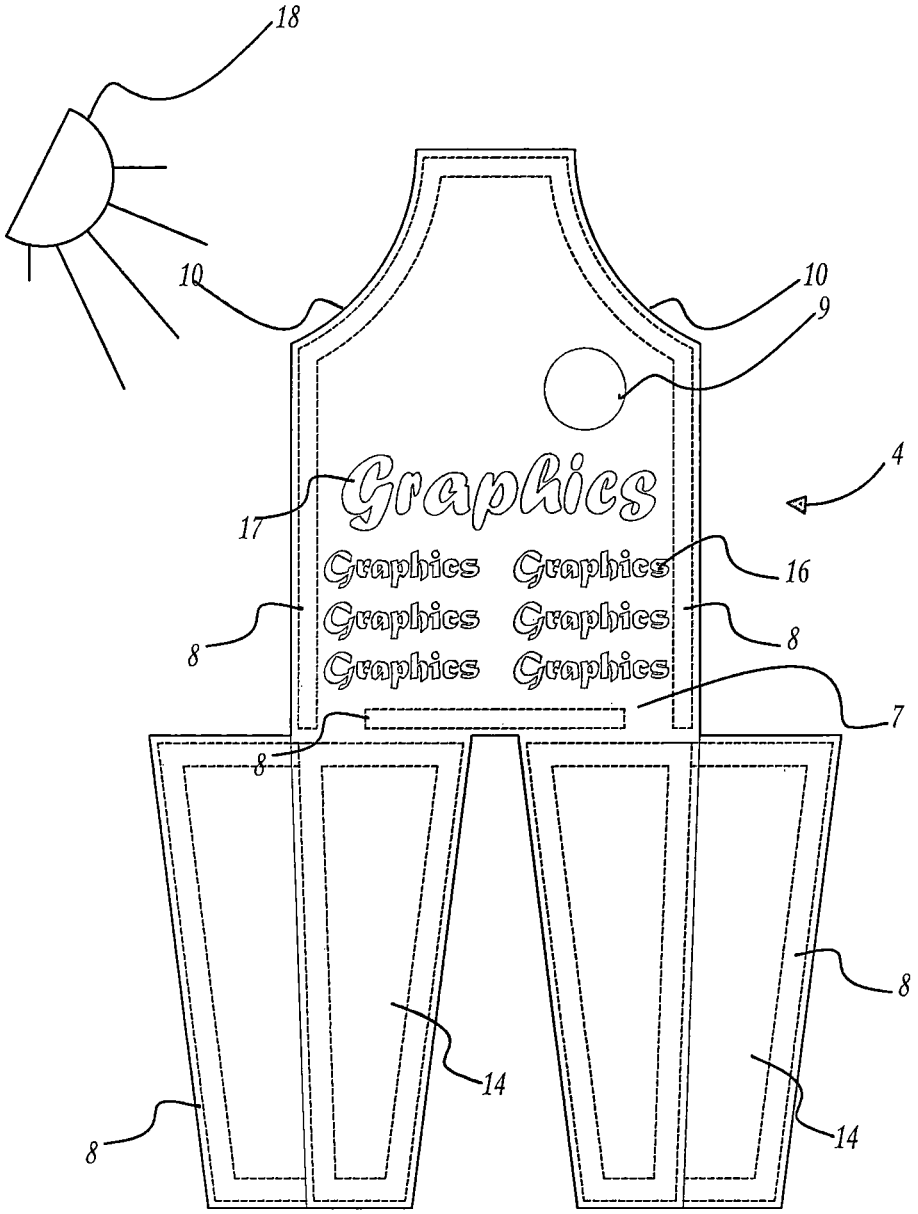
FIG. 4 illustrates the disposable body shield of the present invention in accordance with the one embodiment wherein the disposable body shield has leg coverings.
Figure 5:
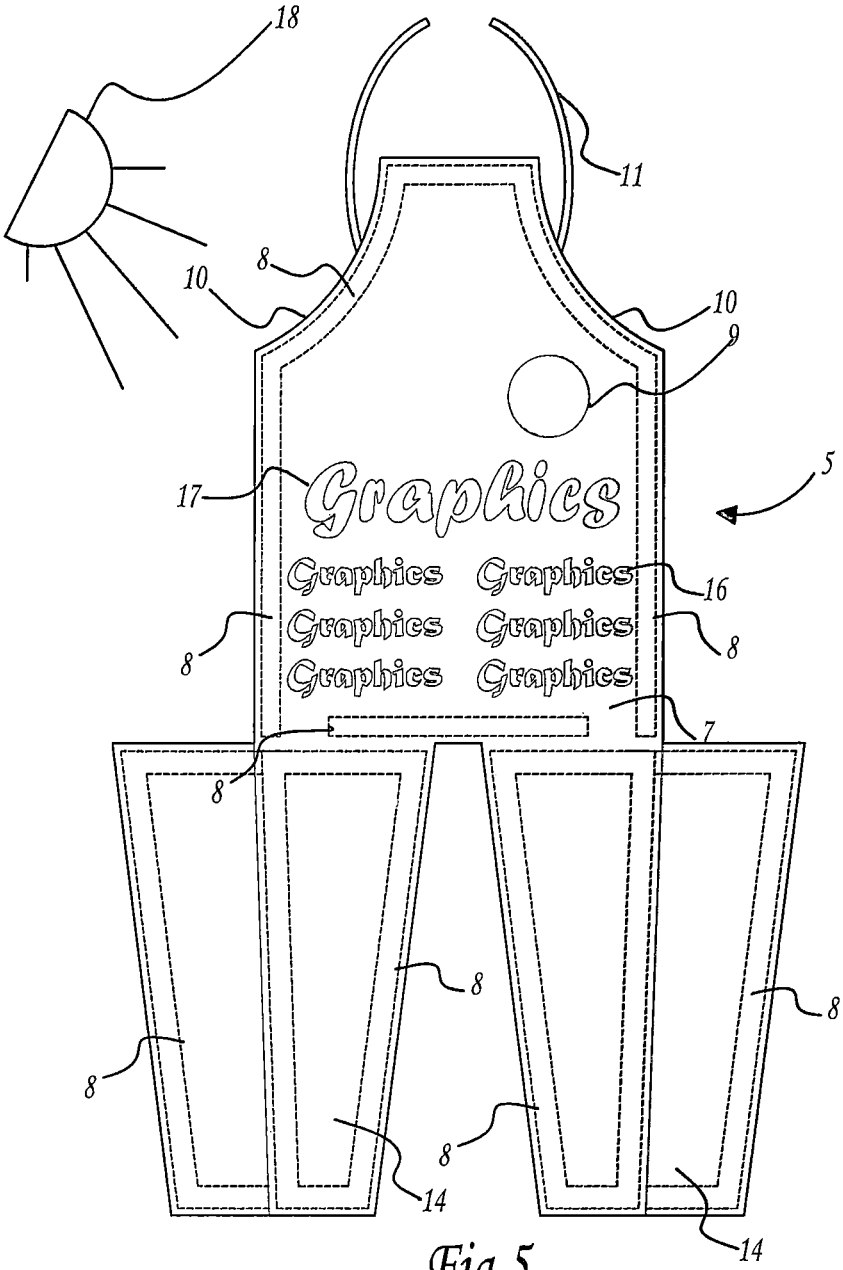
FIG. 5 illustrates the disposable body shield of the present invention in accordance with the one embodiment wherein the disposable body shield has a yoke and leg coverings
Figure 6:
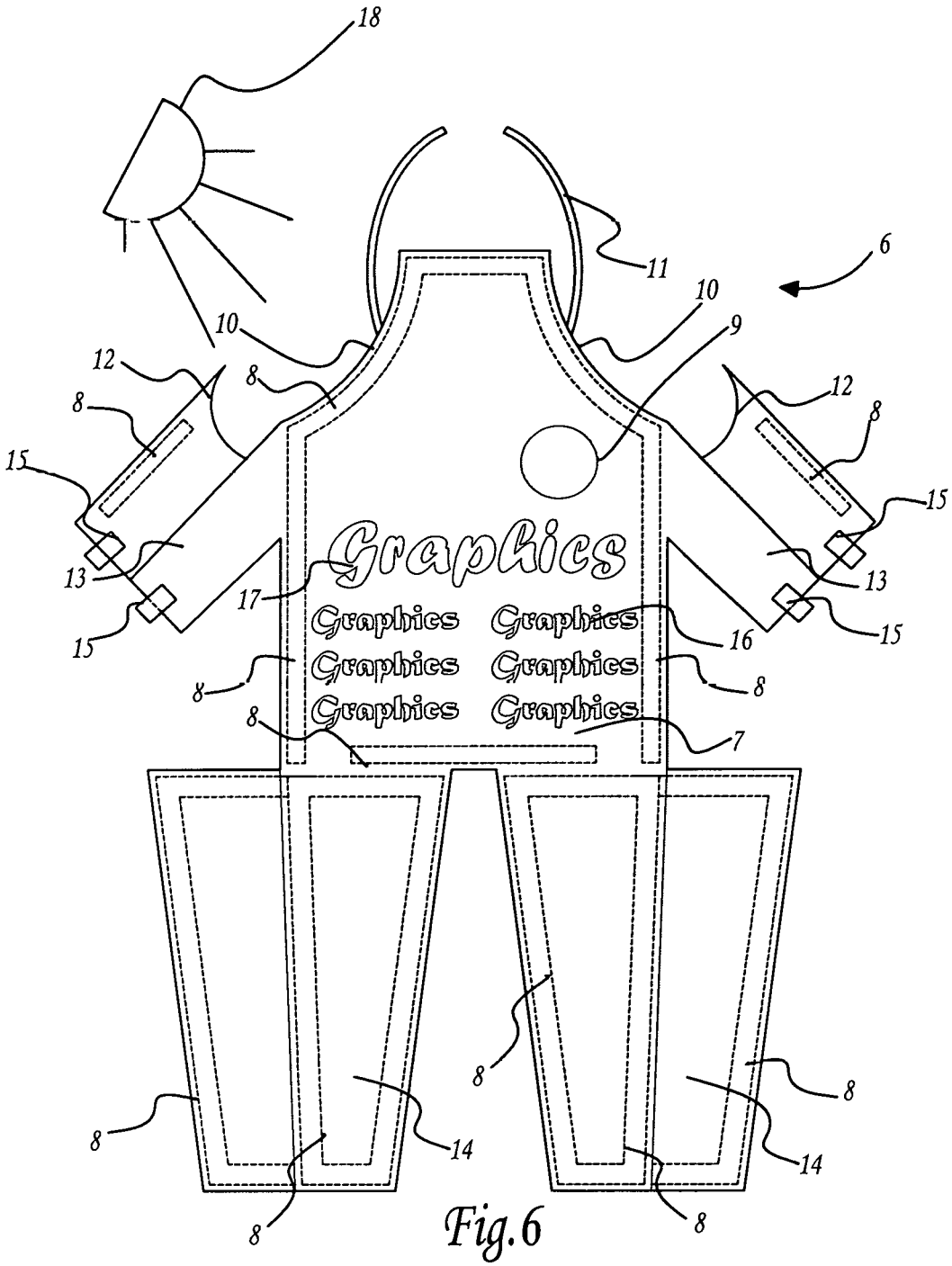
FIG. 6 illustrates the disposable body shield of the present invention in accordance with the one embodiment wherein the disposable body shield has a yoke, leg and arm covering.

The disposable body shied shield of the present invention in accordance with one embodiment shown in FIG. 1. The disposable body shield of the present invention in accordance with another embodiment wherein a yoke is shown in FIG. 2. The disposable body shield of the present invention hi accordance with another embodiment wherein a yoke and arm coverings are shown in FIG. 3. The disposable body shield of the present invention in accordance with another embodiment wherein leg coverings are shown in FIG. 4. The disposable body shield of the present invention in accordance with another embodiment wherein a yoke and leg coverings are shown in FIG. 5. The disposable body shield of the present invention in accordance with another embodiment wherein a yoke, arm and leg coverings are shown in FIG. 6. With reference to each figure, the same numerals will be used to describe like elements.

Referencing FIG. 1. The disposable body shield 1 made of any known synthetic or non-woven biodegradable material. For example, kraft paper, wax coated laminated paper, wax paper and etc., alternatively with a 15,lb-30,lb weight for shield 7 for covering the torso area which is eco-friendly and does not cause harm to the environment. However, those skilled in the art will understand that the weight of the material is not limited to any particular weight or thickness. Kraft and wax paper are made from soybeans, vegetable oil or paraffin, also as well as bees wax and these components are compostable materials. Also, the disposable body shield is provided with an adhesive element 8 attaching directly to one's bare skin or garment. Preferably, adhesive element 8 range from 1 to 2 inches in width. However, those skilled in the art will understand that the widths of the adhesive elements are not limited to any particular widths. Contoured cut-out sections 10 at the distal point of which the remainder of the body portion extends. The disposable body shield is also provided with a placement area for logos 9. Background printed branding repeated graphic pattern 16. Photochromic changing inks that activate when exposed to outdoor ultraviolet sunlight 17. Ultraviolet outdoor sunlight 18.

Referencing FIG. 2. The disposable body shield 2 made of any known synthetic or non-woven biodegradable material for example, kraft paper or wax coated laminated paper or wax paper and etc. for shield 7 covering the torso area, and also have a yoke 11 can be a loop or two separate pieces that can be tied to fit the user preference. An adhesive element 8 attaching directly to one's bare skin or garment that allows the shield to be easily attached and quickly removed. Contoured cut-out sections 10 at the distal point of which the remainder of the body portion extends. The disposable body shield is also provided with a placement area for logos 9. Background printed branding repeated graphic pattern 16. Photochromic changing inks that activate when exposed to outdoor ultraviolet sunlight 17. Ultraviolet outdoor sunlight 18.

Referencing FIG. 3. The disposable body shield 3 made of any known synthetic or non-woven biodegradable material for example, kraft paper or wax coated laminated paper or wax paper and etc. for shield 7 covering the torso area, and also having a yoke 11. A commercial adhesive element 8 attaching directly to the one's bare skin or garment that allows the shield to be easily attached and quickly removed. Contoured cut-out sections 10 at the distal point of which the remainder of the body portion extends. Area placement for Logos 9. Background printed branding repeated graphic pattern 16. Photochromic changing inks that activate when exposed to outdoor ultraviolet sunlight 17. Ultraviolet outdoor sunlight 18. Arm coverings 13 folds to form a sleeve are provided with an access slit 12 where the user can easily slip their arm through for maximum coverage. The sleeve arms coverings 13 comprising of kraft paper, wax coated laminated paper or wax paper alternatively with a 15,lb-30, lb weight. Also, a commercial adhesive element 15 is provided at the cuff of the wrist area to attach to one's skin or garment. One half of the commercial adhesive element 15 is permanently attached to the sleeve with the other half to be removed along said backside that is covered by a corresponding layer of biodegradable cover film to prevent the adhesive from attaching to objects.

Referencing FIG. 4. The disposable body shield 4 made of any known synthetic or non-woven biodegradable material for example, kraft paper, wax coated laminated paper or wax paper and etc. for shield 7 covering the torso area. A commercial adhesive element 8 attaching directly to the bare skin or one's garment that allows the shield to be easily attached and quickly removed. Contoured cut-out sections 10 at the distal point of which the remainder of the body portion extends. Area placement for Logos 9. Background printed branding repeated graphic pattern 16. Photochromic changing inks that activate when exposed to outdoor ultraviolet sunlight 17. Ultraviolet outdoor sunlight 18. Leg coverings 14 are provided. The leg 14 coverings made of any known synthetic or non-woven biodegradable material, for example kraft paper, wax coated laminated paper or wax paper and etc., alternatively with a 15,lb-30,lb weight, folds over for maximum coverage.

Referencing FIG. 5. The disposable body shield 5 made of any known synthetic non-woven biodegradable material for example, kraft paper, wax coated laminated paper or wax paper and etc. for shield 7 covering the torso area. Also, a yoke 11 is provided. A commercial adhesive element 8 attaching directly to the bare skin or one's garment that allows the shield to be easily attached and quickly removed. Contoured cut-out sections 10 at the distal point of which the remainder of the body portion extends. Area placement for Logos 9. Background printed branding repeated graphic pattern 16. Photochromic changing inks that activate when exposed to outdoor ultraviolet sunlight 17. Ultraviolet outdoor sunlight 18. Leg coverings 14 are provided, folds over for maximum coverage.

Referencing FIG. 6. The disposable body shield 6 made of any known non-woven biodegradable material such as kraft paper, wax coated laminated paper or wax paper and etc. for shield 7 covering the torso area. Also, a yoke 11 is provided. A commercial adhesive element 8 attaching directly to the bare skin or one's garment that allows the shield to be easily attached and quickly removed. Contoured cut-out sections 10 at the distal point of which the remainder of the body portion extends. Area placement for Logos 9. Background printed branding repeated graphic pattern 16. Photochromic changing inks that activate when exposed to outdoor ultraviolet sunlight 17. Ultraviolet outdoor sunlight 18. Leg coverings 14 are provided, folds over for maximum coverage. Arm coverings 13 folds to form a sleeve are provided with an access slit 12 where the user can easily slip their arm through for maximum coverage. Also, a commercial adhesive element 15 is provided at the cuff of the wrist area to attach to one's skin or garment. One half of the commercial adhesive element 15 is permanently attached to the sleeve with the other half to be removed along said backside that is covered by a corresponding layer of biodegradable cover film to prevent the adhesive from attaching to objects.

What is claimed is:

1. A disposable body shield comprising:

a body portion configured to cover a front torso of a wearer and having a first lateral side edge, a second lateral side edge, and a lower edge;

a first folding arm portion extending outwardly from the first lateral side edge of the body portion and a second folding arm portion extending outwardly from the second lateral side edge of the body portion, the first folding arm portion having lateral first and second lateral edges and a bottom edge and the second folding arm portion having first and second lateral edges and a bottom edge;

a plurality of adhesive strips configured to adhere to clothing or skin of the wearer, the plurality of adhesive strips comprising;

a first strip along the first lateral side edge of the body portion, a second strip along the second lateral side edge of the body portion, a third adhesive strip along the first lateral edge of the first folding arm portion, a fourth adhesive strip along the first lateral edge of the second folding arm portion; and wherein the body portion and the first and second folding arm portions are made from a non-woven or paper material with an anti-microbial element.

2. The disposable body shield of claim 1, wherein the body portion comprises at least one of a photochromic changing ink and a glow in the dark element on a front surface of the body portion.

3. The disposable body shield of claim 1, further comprising a yoke attached to a top upper edge portion of the body portion.

4. The disposable body shield of claim 1, wherein the plurality of adhesive strips comprises at least one fifth strip, wherein a first half of the at least one fifth strip is attached to the bottom edge of the first folding arm portion and a second half of the at least one fifth strip extending outwardly from the bottom edge of the first folding arm portion and is covered with a biodegradable film that is configured to be removed to expose adhesive on the second half of the at least one fifth strip.

5. The disposable body shield of claim 4, wherein the plurality of adhesive strips comprises at least one sixth strip, wherein a first half of the at least one sixth strip is attached to the bottom edge of the second folding arm portion and a second half of the at least one sixth strip extending outwardly from the bottom edge of the second folding arm portion and is covered with a biodegradable film that is configured to be removed to expose adhesive on the second half of the at least one sixth strip.

6. A disposable body shield comprising:

a body portion configured to cover a front torso of a wearer and having a first lateral side edge, a second lateral side edge, and a lower edge;

first and second leg portions extending downwardly from the lower edge of the body portion and being spaced apart from each other, the first leg portion having lateral first and second lateral edges and a bottom edge and the second leg portion having first and second lateral edges and a bottom edge;

a plurality of adhesive strips configured to adhere to clothing or skin of the wearer, the plurality of adhesive strips comprising;

a first strip along the first lateral side edge of the body portion, a second strip along the second lateral side edge of the body portion, a third adhesive strip along one of the first lateral edge, the second lateral edge, and the bottom edge of the first leg portion, a fourth adhesive strip along one of the first lateral edge, the second lateral edge, and the bottom edge of the second leg portion; and wherein the body portion and the first and second leg portions are made from a non-woven or paper material with an anti-microbial element.

7. The disposable body shield of claim 6, wherein the body portion comprises at least one of a photochromic changing ink and a glow in the dark element on a front surface of the body portion.

8. The disposable body shield of claim 6, further comprising a yoke attached to a top upper edge portion of the body portion.

9. A disposable body shield comprising:

a body portion configured to cover a front torso of a wearer and having a first lateral side edge, a second lateral side edge, and a lower edge;

a first folding arm portion extending outwardly from the first lateral side edge of the body portion and a second folding arm portion extending outwardly from the second lateral side edge of the body portion, the first folding arm portion having lateral first and second lateral edges and a bottom edge and the second folding arm portion having first and second lateral edges and a bottom edge;

first and second leg portions extending downwardly from the lower edge of the body portion and being spaced apart from each other, the first leg portion having lateral first and second lateral edges and a bottom edge and the second leg portion having first and second lateral edges and a bottom edge;

a plurality of adhesive strips configured to adhere to clothing or skin of the wearer, the plurality of adhesive strips comprising;

a first strip along the first lateral side edge of the body portion, a second strip along the second lateral side edge of the body portion, a third adhesive strip along the first lateral edge of the first folding arm portion, a fourth adhesive strip along the first lateral edge of the second folding arm portion;

a fifth adhesive strip along one of the first lateral edge, the second lateral edge, and the bottom edge of the first leg portion, a sixth adhesive strip along one of the first lateral edge, the second lateral edge, and the bottom edge of the second leg portion; and wherein the body portion, the first and second folding arm portions, and the first and second leg portions are made from a non-woven or paper material with an anti-microbial element.

10. The disposable body shield of claim 9, wherein the body portion comprises at least one of a photochromic changing ink and a glow in the dark element on a front surface of the body portion.

11. The disposable body shield of claim 9, further comprising a yoke attached to a top upper edge portion of the body portion.

12. The disposable body shield of claim 9, wherein the plurality of adhesive strips comprises at least one seventh strip, wherein a first half of the at least one seventh strip is attached to the bottom edge of the first folding arm portion and a second half of the at least one seventh strip extending outwardly from the bottom edge of the first folding arm portion and is covered with a biodegradable film that is configured to be removed to expose adhesive on the second half of the at least one seventh strip.

13. The disposable body shield of claim 12, wherein the plurality of adhesive strips comprises at least one eighth strip, wherein a first half of the at least one eighth strip is attached to the bottom edge of the second folding arm portion and a second half of the at least one eighth strip extending outwardly from the bottom edge of the second folding arm portion and is covered with a biodegradable film that is configured to be removed to expose adhesive on the second half of the at least one eighth strip.

* * * * *